US011525328B2

(12) United States Patent
Hrupp

(10) Patent No.: US 11,525,328 B2
(45) Date of Patent: Dec. 13, 2022

(54) STRADDLE PACKER WITH FLUID PRESSURE PACKER SET AND AUTOMATIC STAY-SET

(71) Applicant: Exacta-Frac Energy Services, Inc., Conroe, TX (US)

(72) Inventor: Joze John Hrupp, Montgomery, TX (US)

(73) Assignee: Exacta-Frac Energy Services, Inc., Conroe, TX (US)

( * ) Notice: Subject to any disclaimer, the term of this patent is extended or adjusted under 35 U.S.C. 154(b) by 70 days.

(21) Appl. No.: 17/175,894

(22) Filed: Feb. 15, 2021

(65) Prior Publication Data

US 2021/0164320 A1 Jun. 3, 2021

Related U.S. Application Data

(63) Continuation of application No. 16/272,225, filed on Feb. 11, 2019, now Pat. No. 10,975,656.

(51) Int. Cl.

| | |
|---|---|
| ***E21B 33/1295*** | (2006.01) |
| ***E21B 23/00*** | (2006.01) |
| ***E21B 23/06*** | (2006.01) |
| ***E21B 33/124*** | (2006.01) |

(52) U.S. Cl.

CPC ..... *E21B 33/1295* (2013.01); *E21B 23/006* (2013.01); *E21B 23/06* (2013.01); *E21B 33/124* (2013.01)

(58) Field of Classification Search

CPC .... E21B 33/1295; E21B 23/006; E21B 23/06; E21B 33/124

See application file for complete search history.

(56) References Cited

U.S. PATENT DOCUMENTS

| | | | |
|---|---|---|---|
| 2,769,497 | A | 11/1956 | Rejstle, Jr. |
| 2,927,638 | A | 3/1960 | Hall, Sr. |
| 3,090,436 | A | 5/1963 | Briggs, Jr. |
| 5,383,520 | A | 1/1995 | Tucker et al. |
| 5,803,177 | A | 9/1998 | Hriscu et al. |
| 5,890,540 | A | 4/1999 | Pia et al. |
| 6,253,856 | B1 | 7/2001 | Ingram et al. |
| 6,484,805 | B1 | 11/2002 | Perkins et al. |
| 6,776,239 | B2 | 8/2004 | Elsinger et al. |
| 6,832,654 | B2 | 12/2004 | Ravensburger et al. |
| 7,377,834 | B2 | 3/2008 | Surjaatmadja et al. |
| 7,500,526 | B2 | 3/2009 | Telfer |
| 7,789,163 | B2 | 9/2010 | Kratochvil et al. |
| 8,201,631 | B2 | 6/2012 | Stromquist et al. |
| 8,336,615 | B2 | 12/2012 | Hughes et al. |
| 8,490,702 | B2 | 7/2013 | Stromquist et al. |
| 9,016,390 | B2 | 4/2015 | Stewart et al. |
| 9,334,714 | B2 | 5/2016 | Stromquist et al. |
| 9,580,990 | B2 | 2/2017 | Flores et al. |

(Continued)

*Primary Examiner* — Dany E Akakpo

(74) *Attorney, Agent, or Firm* — JK Intellectual Property Law, PA

(57) ABSTRACT

A straddle packer has a floating auto-J sleeve that automatically shifts the straddle packer from a run-in condition to a stay-set condition after pumping of high-pressure fluid into the straddle packer in excess of a predetermined pump rate is terminated. In the stay set condition, packer elements of the straddle packer remain in sealing contact with a well casing or well bore into which the straddle packer has been run.

20 Claims, 7 Drawing Sheets

(56) References Cited

U.S. PATENT DOCUMENTS

| | | | | |
|---|---|---|---|---|
| 9,598,939 | B2 | 3/2017 | Lee | |
| 2005/0077053 | A1 | 4/2005 | Walker et al. | |
| 2007/0034370 | A1 | 2/2007 | Moyes | |
| 2011/0198082 | A1 | 8/2011 | Stromquist et al. | |
| 2015/0376979 | A1 | 12/2015 | Mitchell et al. | |
| 2016/0258258 | A1* | 9/2016 | Jani | E21B 23/006 |
| 2016/0369585 | A1 | 12/2016 | Limb et al. | |
| 2018/0238131 | A1* | 8/2018 | Mackenzie | E21B 23/006 |

* cited by examiner

STRADDLE PACKER WITH FLUID PRESSURE PACKER SET AND AUTOMATIC STAY-SET

CROSS REFERNCE TO RELATED APPLICATIONS

This application is a continuation of U.S. patent application Ser. No. 16/272,225 filed Feb. 11, 2019 and related to Applicant's U.S. patent application Ser. No. 15/961,947 filed on Apr. 25, 2018.

FIELD OF THE INVENTION

This invention relates in general to precision fracking systems and, in particular, to a novel straddle packer with fluid pressure packer set and automatic stay-set used for cased wellbore or open hole well stimulation or remediation.

BACKGROUND OF THE INVENTION

Wellbore pressure isolation tools, commonly referred to as "straddle packers", are known and used to pressure isolate a downhole area of interest in a cased or open hydrocarbon wellbore for the purpose of what is known as focused or precision well stimulation or remediation. Straddle packers designed for this purpose are well known, but their use has been associated with operational issues that frequently render them unreliable.

Applicant therefore invented a straddle packer with fluid pressure packer set and velocity bypass described in the above-referenced pending U.S. patent application Ser. No. 15/961,947, the specification of which is incorporated herein by reference in its entirety. While Applicant's fluid pressure set straddle packer overcomes the shortcomings of the prior art, it has been discovered that at times it is advantageous to have the straddle packer stay in a packer set condition after the pumping of fluid into a pressure-isolated section of a formation is terminated to permit, for example, the use of pressure monitors to record pressure drop versus time in order to determine a fracture closure of adjacent, geology.

There therefore exists a need for a novel straddle packer with fluid pressure packer set and automatic stay-set.

SUMMARY OF THE INVENTION

It is therefore an object of the invention to provide a straddle packer with fluid pressure packer set and automatic stay-set.

The invention therefore provides a straddle packer with fluid pressure packer set and automatic stay-set, comprising: a floating auto-J sleeve that rotates freely on a piston mandrel of a modular pressure cylinder of the straddle packer, the floating auto-J sleeve including a continuous auto-J groove in an outer periphery thereof, the auto-J groove including a plurality of auto-J groove run-in slots and a plurality of auto-J groove stay-set slots; and a plurality of auto-J pins installed in a piston sleeve of the modular pressure cylinder, the piston sleeve reciprocating, with respect to the piston mandrel in response to fluid pressure pumped into the straddle packer, and the plurality of auto-J pins being respectively received in and sliding within the continuous auto-J groove as the piston sleeve reciprocates with respect to the piston mandrel and the auto-J sleeve rotates on the piston mandrel.

The invention further provides a straddle packer with fluid pressure packer set and automatic stay-set, comprising: a floating auto-J sleeve that rotates freely on a piston mandrel of a modular pressure cylinder of the straddle packer, the floating auto-J sleeve including a continuous auto-J groove in an outer periphery thereof, the auto-J groove including a plurality of auto-J groove run-in slots, a plurality of auto-J groove pressure-set, slots, a plurality of auto-J groove stay-set slots and a plurality of auto-J groove shift slots; and a plurality of auto-J pins installed in a piston sleeve of the modular pressure cylinder, the piston sleeve reciprocating with respect to the piston mandrel in response to fluid pressure pumped into the straddle packer, and the plurality of auto-J pins being respectively received in and sliding within the continuous auto-J groove as the piston sleeve reciprocates with respect to the piston mandrel and the auto-J sleeve rotates on the piston mandrel.

The invention yet further provides a straddle packer with fluid pressure packer set and automatic stay-set, comprising: a floating auto-J sleeve that rotates freely on a piston mandrel of a modular pressure cylinder of the straddle packer but is restrained from axial movement thereon, the floating auto-J sleeve including a continuous auto-J groove in an outer periphery thereof, the auto-J groove including a plurality of auto-J groove run-in slots, a plurality of auto-J groove pressure-set slots, respective ones of the auto-J groove pressure-set slots being adjacent a first side of respective ones of the plurality of auto-J groove run-in slots, a plurality of auto-J groove stay-set slots, respective ones of the plurality of stay-set slots being adjacent respective ones of the respective auto-J groove pressure-set slots, and a plurality of auto-J groove shift slots, the plurality of auto-J groove shift slots being between respective ones of the plurality of auto-J groove stay-set slots and a second side of the respective ones of the auto-J groove run-in slots; and a plurality of auto-J pins installed in a piston sleeve of the modular pressure cylinder, the piston sleeve reciprocating with respect to the piston mandrel in response to high-pressure fluid pumped into the straddle packer, and the plurality of auto-J pins being respectively received in and sliding within the continuous auto-J groove as the piston sleeve reciprocates with respect to the piston mandrel and the auto-J sleeve rotates on the piston mandrel.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
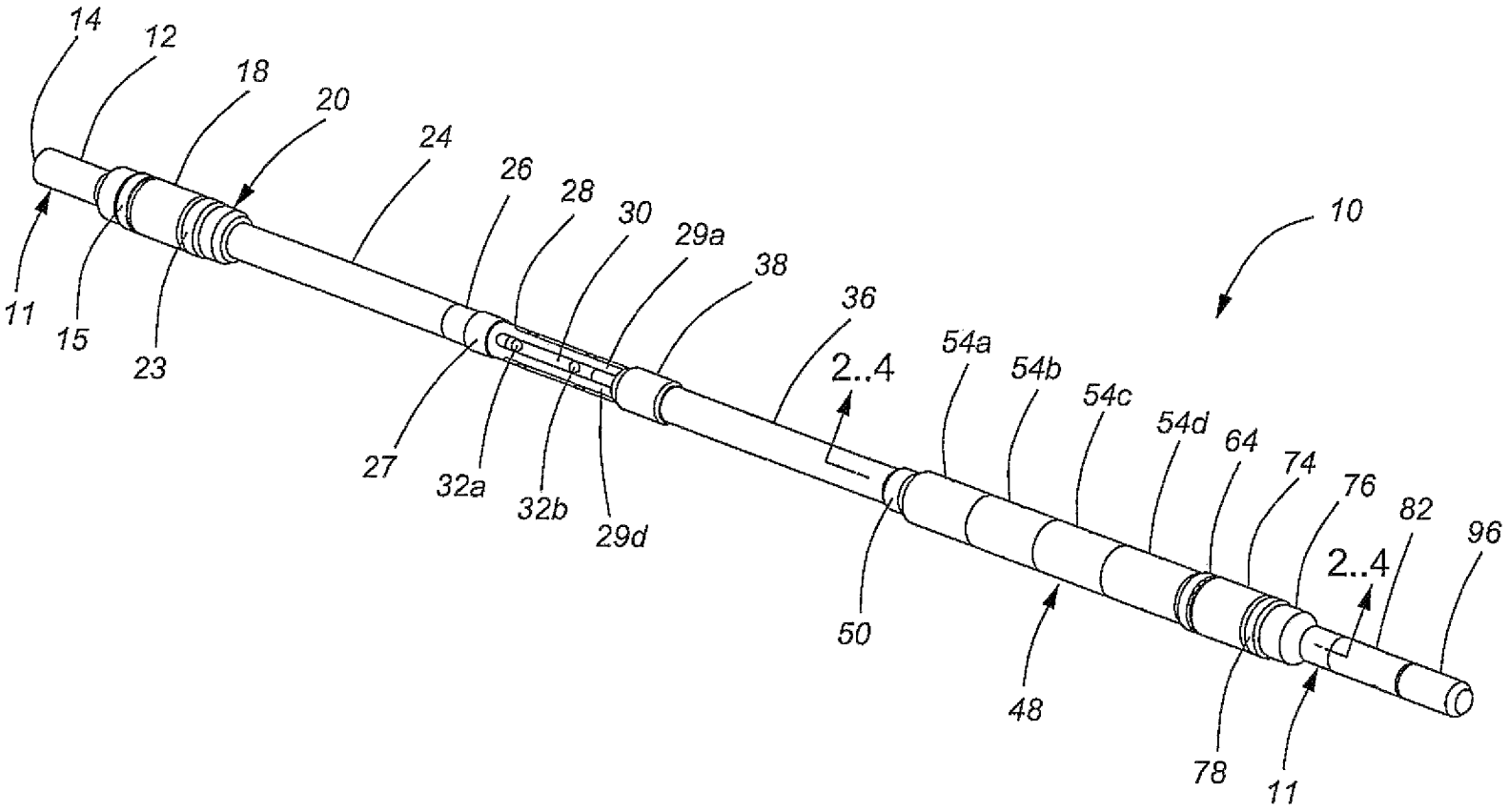
FIG. 1 is a perspective view of an embodiment of a straddle packer with fluid pressure packer set and automatic stay-set in accordance with the invention in a run-in condition.

The invention provides a straddle packer with a fluid pressure boosted packer set and automatic stay-set for use in precision well stimulation or remediation treatments in either open hole or cased wellbores (hereinafter referred to collectively as "wellbores"). The automatic stay-set is enabled by a floating auto-J sleeve that rotates freely on a piston mandrel of a hydraulic piston that sets the straddle packer. A plurality of auto-J pins retained in a piston sleeve that surrounds the floating auto-J sleeve on the piston mandrel respectively engage an auto-J track in the floating auto-J sleeve. The auto-J track is designed to automatically shift the straddle packer from a run-in condition to a stay-set condition, or vice versa, each time the straddle packer is set using pumped fluid pressure. In the run-in condition, the packers of the straddle packer are in a relaxed state and do not provide a fluid seal against a surrounding well casing or well bore. In the set condition, the packers are in fluid sealing contact with the well casing or well bore. In the stay-set condition, the packers remain in sealing contact with the well casing or well bore. When the straddle packer is in the run-in condition, pumping high-pressure fluid into the straddle packer at a rate that exceeds a predetermined threshold pump rate will shift the straddle packer to the set condition. When pumping stops, the straddle packer automatically shifts to the stay-set condition. When the straddle packer is to be moved, the pumps are reactivated to return the straddle packer to operational pressure and then stopped again, which automatically shifts the straddle packer back to the run-in condition.

| Part No. | Part Description |
|---|---|
| 10 | Straddle packer |
| 11 | Multicomponent mandrel |
| 13 | Multicomponent mandrel central passage |
| 14 | Completion string connection |
| 15 | Upper packer element compression shoulder |
| 18 | Upper packer element |
| 20 | Upper compression bell |
| 23 | Upper compression bell shoulder |
| 24 | Upper sliding sleeve |
| 26 | Upper sliding sleeve coupling |
| 27 | Slotted sliding sleeve female coupling end |
| 28 | Slotted sliding sleeve |
| 29a, 29b | Sliding sleeve finger components |

-continued

| Part No. | Part Description |
|---|---|
| 30 | Mandrel flow sub |
| 32a-32h | Mandrel flow sub nozzles |
| 36 | Lower sliding sleeve |
| 38 | Slotted sliding sleeve captured end coupling ring |
| 48 | Modular pressure cylinder |
| 50 | Sleeve/cylinder crossover |
| 54a-54d | Pressure cylinder modules |
| 56a-56d | Pressure pistons |
| 64 | Lower compression bell |
| 74 | Lower packer element |
| 76 | Lower crossover sub |
| 78 | Lower packer element compression shoulder |
| 82 | Velocity bypass sub |
| 96 | Lower end cap |
| 98 | Piston mandrel |
| 100 | Floating auto-J sleeve |
| 102 | Auto-J sleeve uphole end |
| 104 | Auto-J sleeve downhole end |
| 106a-d | Auto-J pins |
| 108 | Auto-J groove |
| 110 | Auto-J groove run-in slots |
| 112 | Auto-J groove pressure-set slots |
| 114 | Auto-J groove stay-set slots |
| 116 | Auto-J groove shift slots |

FIG. 1 is a perspective view of one embodiment of the straddle packer 10 with fluid pressure packer set and automatic stay-set in the run-in condition. The straddle packer 10 has a multicomponent mandrel 11, the majority of which can only be seen in a cross-sectional view as explained in Applicant's co-pending patent application referenced above. The multicomponent mandrel 11 extends from the uphole end to the downhole end of the straddle packer 10. On the uphole end of the multicomponent mandrel 11, a completion string connection component 12 includes a completion string connection 14. The completion string connection component 12 has an upper packer element compression shoulder 15 that abuts an upper packer element 18. On a downhole side of the upper packer element 18 is an upper compression bell 20 having an upper compression bell shoulder 23 for compressing the upper packer element 18. An upper sliding sleeve 24 is connected to a downhole side of the upper compression bell 20. The upper sliding sleeve 24 is connected to an upper sliding sleeve coupling 26, which is in turn connected to a female coupling end 27 of a slotted sliding sleeve 28. In one embodiment, the slotted sliding sleeve 28 has four slotted sliding sleeve finger components, two of which, 29*a*, 29*d*, can be seen in this view. The slotted sliding sleeve finger components define four slots that respectively expose at least one mandrel flow sub nozzle of a mandrel flow sub 30. In this embodiment, the mandrel flow sub 30 has a plurality of mandrel flow sub nozzles (only 32*a* and 32*b* are visible in this view). A downhole end of the sliding sleeve finger components are threadedly connected to a slotted sliding sleeve captured end coupling ring 38 that is connected to a lower sliding sleeve 36. A downhole end of the lower sliding sleeve 36 is connected to a sleeve/cylinder crossover 50 that is in turn connected to a modular pressure cylinder 48 assembled by interconnecting a plurality of pressure cylinder modules, 54*a*-54*d* in this embodiment. The pressure cylinder module 54*d* is connected to a lower compression bell 64 that abuts an elastomeric lower packer element 74. A lower crossover sub 76 having a lower packer element compression shoulder 78 abuts a downhole end of the lower packer element 74. A velocity bypass sub 82 is connected to a downhole side of the lower crossover sub 76. A lower end cap 96, which caps the downhole end of the multicomponent mandrel 11, is connected to the velocity bypass sub 82.

The internal components and operation of Applicant's straddle packer with fluid pressure packer set and velocity bypass are described in detail in the above-identified co-pending U.S. patent application Ser. No. 15/981,947, and that description will not be repeated here.

Figure 2:
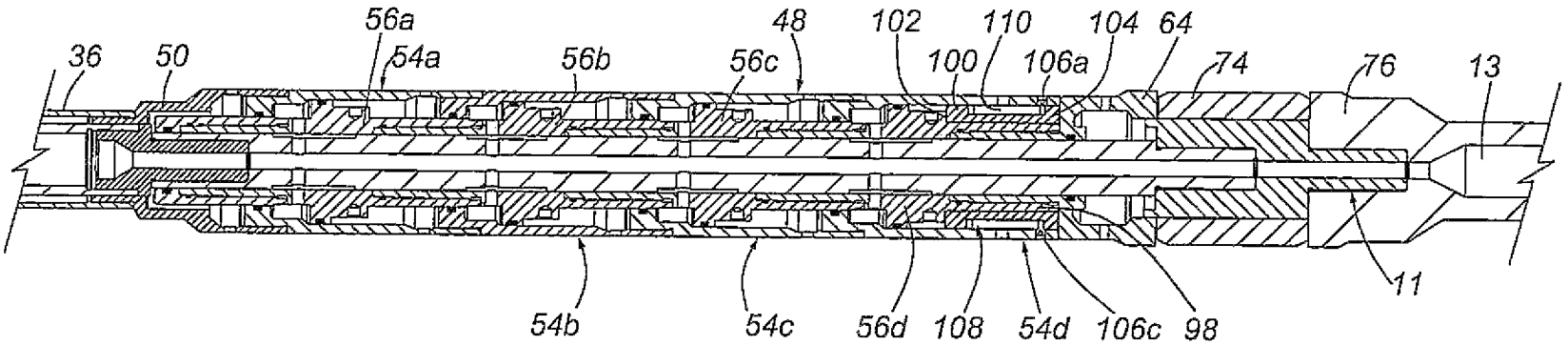
FIG. 2 is a cross-sectional view taken between lines 2..4-2..4 of FIG. 1, of a modular cylinder portion of the straddle packer in the run-condition.

FIG. 2 is a cross-sectional view taken between lines 2..4-2..4 of FIG. 1 of the modular pressure cylinder 48 of the straddle packer 10 in the run-condition. In accordance with the invention, the straddle packer 10 is provided with a floating auto-J sleeve 100, having an auto-J sleeve uphole end 102 and an auto-J sleeve downhole end 104. The straddle packer 10 is further provided with a plurality of auto-J pins 106 that are installed in the piston sleeve 55d adjacent the lower compression bell 64. In one embodiment there are 4 auto-J pins 106*a*, 106*b*, 106*c* and 106*d*, only two of which, 106*a* and 106*c*, are visible in this cross-sectional view. The floating auto-J sleeve 100 is mounted on a piston mandrel 98 of pressure piston 56*d*, and rotates freely on the piston mandrel 98, but is restrained from any axial movement by the pressure piston 56*d* which abuts the auto-J sleeve uphole end 102 and the upper compression bell 20 which abuts the auto-J sleeve downhole end 104. A continuous auto-J groove 108 is machined in an outer periphery of the floating auto-J sleeve 100. One embodiment of the continuous auto-J groove 108 will be described below in detail with reference to FIGS. 7*a*-7*d*. The auto-J pins 106*a*-106*d* have inner ends that respectively slide within the auto-J groove 108, as will also be explained below in detail. In the run-in condition, the auto-J pins 106*a*-106*d* are respectively in auto-J groove run-in slots 110, as better seen in FIG. 7*a*.

Figure 3:
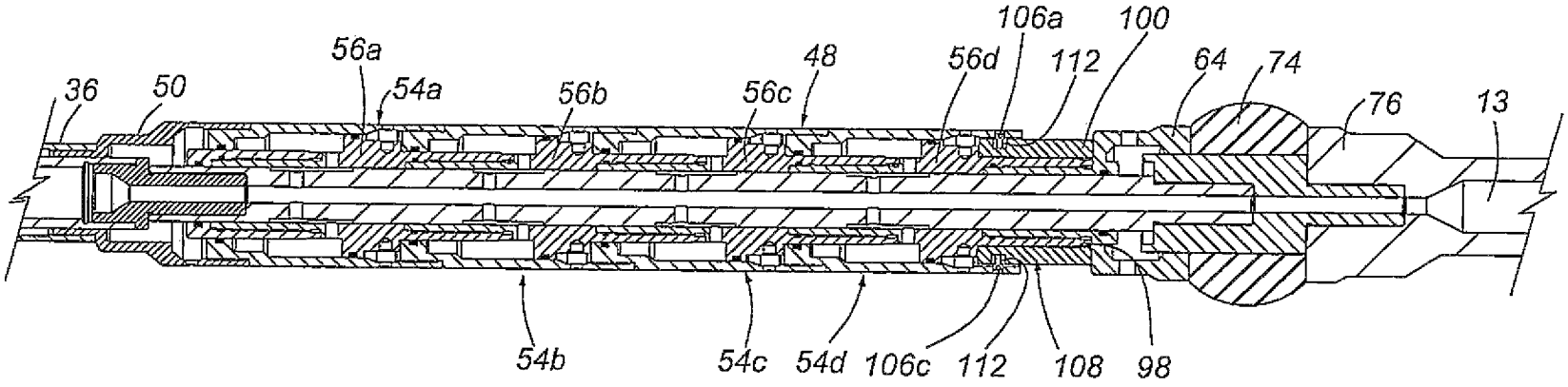
FIG. 3 is a cross-sectional view'taken between lines 2..4-2..4 of FIG. 1, of the modular cylinder portion of the embodiment of the straddle packer in a packer set condition.

FIG. 3 is a cross-sectional view, taken between lines 2..4-2..4 of FIG. 1, of the modular cylinder portion 48 of one embodiment of the straddle packer 10 in a packer set condition. As explained in Applicant's above-referenced co-pending patent application, when high pressure fluid is pumped into the straddle packer 10, the modular pressure cylinder 48 compresses the upper packer element 18 and the lower packer element 74 to pressure isolate a section of the wellbore between the respective packer elements 18, 74 after a pumped fluid rate exceeds a predetermined pump rate threshold. Activation of the modular pressure cylinder 48 induces movement of the pressure cylinder module 54*d* relative to the pressure piston 56*d*, which in turn slides the auto-J pins 106*a*-106*d* within the auto-j groove 108 towards the uphole end 102 of the floating auto-J sleeve 100. At full pressure-boosted compression of the packer elements 18, 74, the auto-J pins 106*a*-106*d* respectively slide into auto-J groove pressure-set slots 112, as best seen in FIG. 7*b*, effecting a slight rotation of the floating auto-J sleeve 100 on the piston mandrel 98 as the auto-J pins 106*a*-106*d* shift to the new location.

Figure 4:
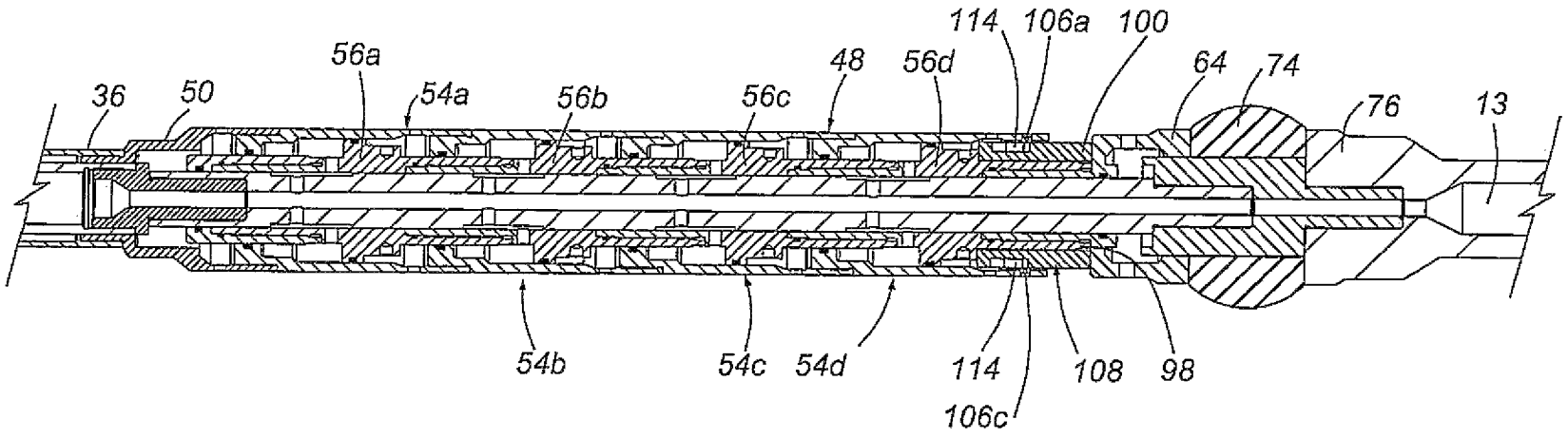
FIG. 4 is a cross-sectional view taken between lines 2..4-2..4 of FIG. 1 of the modular cylinder portion of the embodiment of the straddle packer in a stay-set condition.

FIG. 4 is a cross-sectional view of the modular cylinder portion 48 of the embodiment of the straddle packer 10 taken between lines 2..4-2..4 of FIG. 1, in a stay-set condition. When pumping of high-pressure fluid into the straddle packer 10 is terminated, pressure within a central passage 13 of the straddle packer 10 begins to bleed off and the packer elements 18, 74 start returning to the relaxed, run-in position. This induces relative movement between the pressure cylinder module 54*d* and the piston mandrel 98, forcing the auto-J pins 106*a*-106*d* through the continuous auto-J groove 108 to auto-J groove stay-set slots 114, best seen in FIG. 7*c*, effecting a further rotation of the floating auto-J sleeve 100 on the piston mandrel 98. In the stay-set condition, the respective packer elements 18, 74 are slightly relaxed from the pressure-boosted condition, but continue to provide a secure high-pressure fluid seal with a well bore or well casing in which the straddle packer 10 is packed off. This permits, as one example, the monitoring of downhole pressure versus time to determine a fracture closure of adjacent geology.

Figure 5:
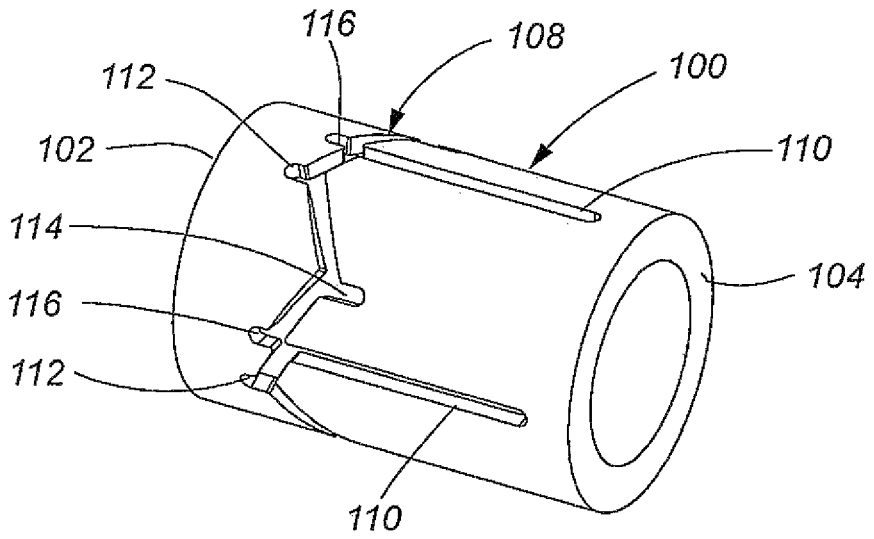
FIG. 5 is a perspective view of a floating auto-J sleeve with an auto-J groove in accordance with one embodiment of the invention.
Figure 6:
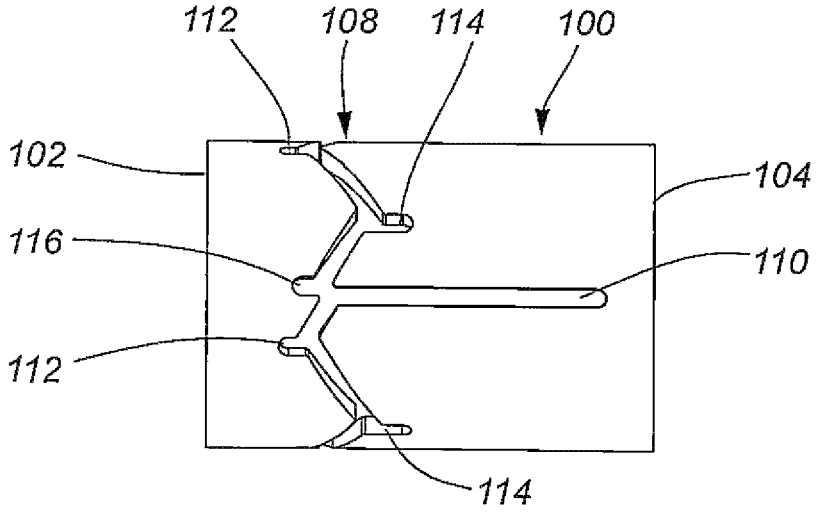
FIG. 6 is a side elevational view of the floating auto-J sleeve shown in FIG. 5.

FIG. 5 is a perspective view of the floating auto-J sleeve 100 with the auto-J groove 108 in accordance with one embodiment of the invention. As explained above, the floating auto-J sleeve 100 has the uphole end 102 and the downhole end 104. As further explained above, the auto-J groove 108 is a continuous groove machined around a periphery of the floating auto-J sleeve 100. The continuous auto-J groove 108 includes auto-J groove run-in slots 110, auto-J groove pressure-set slots 112, auto-J groove stay-set slots 114, and auto-J groove shift slots 116, all of which are best seen in FIGS. 7*a*-7*d*. FIG. 6 is a side-elevational view of the floating auto-J sleeve 100 shown in FIG. 5.

Figure 7A:
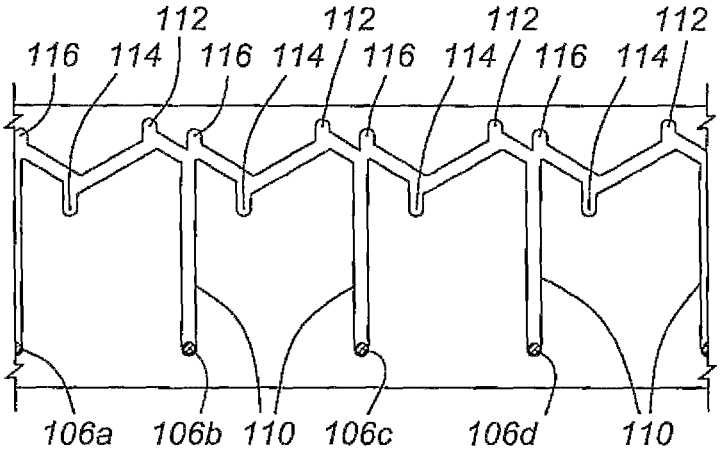
FIG. 7*a* is an orthographic projection of the auto-J groove of the floating auto-J sleeve shown in FIG. 5, illustrating a location of auto-J pins when the straddle packer is in a run-in condition.
Figure 7B:
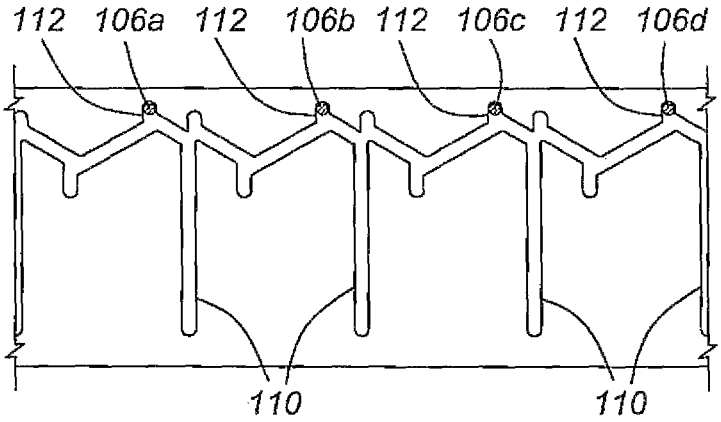
FIG. 7*b* is an orthographic projection of the auto-J groove of the floating auto-J sleeve shown in FIG. 5, illustrating a location of the auto-J pins when the straddle packer is in a pressure-boosted set condition after moving from the run-in condition shown in FIG. 7*a;*

FIG. 7*a* is an orthographic projection of the auto-J groove 108 of the floating auto-J sleeve 100 shown in FIG. 5, illustrating a location of the auto-J pins 106*a*-106*d* when the straddle packer 10 is in the run-in condition in which the respective packer elements 18, 74 are in a relaxed condition that permits the straddle packer 10 to be run into a well casing or a well bore, or moved freely within the well casing or a well bore. In the run-in condition of the straddle packer 10, the respective auto-j pins 106*a*-106*d* are located at or near a downhole end of the respective auto-J run-in slots 110.

FIG. 7*b* is an orthographic projection of the auto-J groove 108 of the floating auto-J sleeve 100 shown in FIG. 5, illustrating the auto-J pins 106*a*-106*d* in auto-J groove pressure-set slots 112. As explained above, the auto-J pins 106*a*-106*d* shift automatically from the auto-J run-in slots 110 to the auto-J pressure-set slots 112 when high-pressure fluid is pumped at a sufficient rate into the straddle packer 10. When the auto-J pins 106*a*-106*d* are in the auto-J pressure-set slots 112, the respective packer elements 18, 74 are in maximum compression and provide a very high-pressure fluid seal against a well casing or well bore in which the straddle packer 10 is located.

Figure 7C:
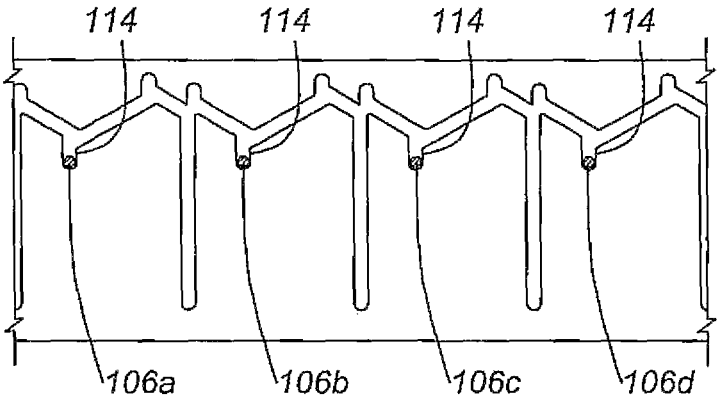
FIG. 7*c* is an orthographic projection of the auto-J groove of the floating auto-J sleeve shown in FIG. 5, illustrating a location of the auto-J pins when the straddle packer is in a stay-set condition after moving from the pressure-boosted set condition shown in FIG. 7*b*.

FIG. 7*c* is an orthographic projection of the auto-J groove 108 of the floating auto-J sleeve 100 shown in FIG. 5, illustrating the auto-J pins 106*a*-106*d* in the auto-J groove stay-set slots 114, which keeps the straddle packer 10 in the stay-set condition. As explained above, when the straddle packer 10 is in the stay-set condition, the respective packer elements 18, 74 are slightly relaxed from the pressure-boosted set condition, but still provide a secure high-pressure fluid seal with the well casing or the well bore.

Figure 7D:
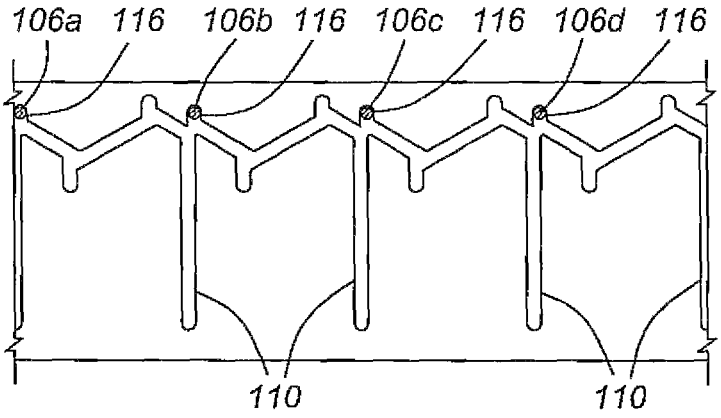
FIG. 7*d* is an orthographic projection of the auto-J groove of the floating auto-J sleeve shown in FIG. 5, illustrating a location of the auto-J pins when the straddle packer is in a pressure-boosted shift condition after moving from the stay-set condition shown in FIG. 7*c*.

FIG. 7*d* is an orthographic projection of the auto-J groove 108 of the floating auto-J sleeve 100 shown in FIG. 5, illustrating a location of the auto-J pins 106*a*-106*d* in the auto-J groove shift slots 116 when the straddle packer 10 is in a pressure-boosted shift condition after being in the stay-set condition. In this condition, pumping of high-pressure stimulation fluid into a section of a production formation isolated by the respective packer elements 18, 74 may be performed, or pumping may be terminated as soon as operational fluid pressure is achieved. In either case, the relaxation of the packer elements 18,74 after pumping is terminated will automatically move the auto-J pins 106*a*-106*d* from the auto-J shift slots 116 to the auto-J run-in slots 110, which shifts the straddle packer 10 back to the run-in condition shown in FIG. 7*a*.

As will be understood by those skilled in the art, shifting of the straddle packer 10 from the run-in condition to the stay-set condition and back again to the run-in condition is exclusively dependent of fluid pressure and fluid flow control and is independent of work string manipulation of any sort. This is particularly advantageous in very long lateral bores, where precise work string manipulations may be difficult, if not impossible, due to frictional drag on the work string.

It should be further understood that the shape and configuration of the auto-J groove 108 is illustrative only.

The explicit embodiments of the invention described above have been presented by way of example only. The scope of the invention is therefore intended to be limited solely by the scope of the appended claims.

I claim:

1. A straddle packer with fluid pressure packer set and automatic stay-set, comprising:

a hydraulic piston adapted to urge the straddle packer to a set condition in response pumped fluid pressure, the hydraulic piston having a piston mandrel and a piston cylinder that surrounds the piston mandrel;

a floating auto-J sleeve adapted to rotate on the piston mandrel but constrained from axial movement on the piston mandrel, the floating auto-J sleeve including a continuous auto-J groove in an outer periphery thereof, the continuous auto-J groove including a plurality of auto-J groove run-in slots and a plurality of auto-J groove stay-set slots; and a plurality of auto-J pins installed in the piston sleeve, the piston sleeve reciprocating with respect to the piston mandrel in response to the pumped fluid pressure, and the plurality of auto-J pins being respectively adapted to be received in and slide within the continuous auto-J groove as the piston sleeve reciprocates with respect to the piston mandrel.

2. The straddle packer as claimed in claim 1 wherein the auto-J sleeve is constrained from axial movement by a piston connected to the piston mandrel and a lower packer element compression bell connected to the piston mandrel.

3. The straddle packer as claimed in claim 1 wherein first and second packer elements of the straddle packer are in a relaxed condition when the respective auto-J pins are in the auto-J run-in slots.

4. The straddle packer as claimed in claim 1 further comprising a plurality of auto-J groove pressure-set slots in the continuous auto-J groove.

5. The straddle packer as claimed in claim 4 wherein the first and second packer elements of the straddle packer are urged to a pressure-boosted set condition to provide a high-pressure fluid seal against a well casing or a well bore into which the straddle packer has been run when the auto-J pins are shifted to the auto-J groove pressure-set slots.

6. The straddle packer as claimed in claim 4 wherein respective ones of the auto-J groove pressure-set slots are between respective ones of the auto-J groove run-in slots and respective ones of the auto-J groove stay-set slots.

7. The straddle packer as claimed in claim 1 further comprising a plurality of auto-J groove shift slots in the continuous auto-J groove.

8. The straddle packer as claimed in claim 7 wherein respective ones of the plurality of auto-J groove shift slots are respectively between respective auto-J groove stay-set slots and the respective auto-J groove run-in slots.

9. The straddle packer as claimed in claim 1 wherein first and second packer elements of the straddle packer are adapted to provide a high-pressure fluid seal with a well casing of a well bore into which the straddle packer has been run when the respective auto-J pins are in the respective auto-J groove stay-set slots.

10. The straddle packer as claimed in claim 1 comprising four of the auto-J pins.

11. A straddle packer with fluid pressure packer set and automatic stay-set, comprising:

a floating auto-J sleeve adapted to rotate on a piston mandrel of a hydraulic cylinder of the straddle packer, the floating auto-J sleeve including a continuous auto-J groove in an outer periphery thereof with a plurality of interleaved auto-J slots, comprising auto-J groove run-in slots, auto-J groove shift slots, auto-J groove stay-set slots and auto-J groove pressure-set slots; and a plurality of auto-J pins installed in a piston sleeve of the hydraulic cylinder and having free ends slidably received within the continuous auto-J groove, the piston sleeve being adapted to reciprocate with respect to the piston mandrel in response to fluid pressure pumped into the straddle packer, and the auto-J pins being adapted to slide within the auto-J groove from one set of the auto-J slots to an adjacent set of the auto-J slots with each reciprocation of the hydraulic cylinder.

12. The straddle packer as claimed in claim 11 wherein the auto-J sleeve is restrained from axial movement on the piston mandrel.

13. The straddle packer as claimed in claim 11 wherein first and second packer elements of the straddle packer are in a relaxed condition when the respective auto-J pins are in the auto-J run-in slots.

14. The straddle packer as claimed in claim 11 wherein first and second packer elements of the straddle packer are in a pressure-boosted set condition when the respective auto-J pins are in the auto-J groove pressure-set slots.

15. The straddle packer as claimed in claim 11 wherein first and second packers of the straddle packer provide a high-pressure fluid seal with a well casing or a well bore into which the straddle packer has been run when the respective auto-J pins are in the auto-J groove stay-set slots.

16. The straddle packer as claimed in claim 11 comprising four auto-J pins.

17. A straddle packer with fluid pressure packer set and automatic stay-set, comprising:

a floating auto-J sleeve that is adapted to rotate on a piston mandrel of a hydraulic cylinder of the straddle packer but is constrained from axial movement thereon, the floating auto-J sleeve including a continuous auto-J groove in an outer periphery thereof, the auto-J groove including a plurality of auto-J groove run-in slots respectively adjacent respective ones of auto-J groove pressure-set slots, which are respectively adjacent respective ones of auto-J groove stay-set slots, which are respectively adjacent respective ones of auto-J groove shift slots, which are respectively adjacent respective ones of the auto-J groove run-in slots; and a plurality of auto-J pins installed in a piston sleeve of the hydraulic cylinder, the piston sleeve being adapted to reciprocate with respect to the piston mandrel in response to high-pressure fluid pumped into the straddle packer, and the plurality of auto-J pins being respectively received in and slidable within the continuous auto-J groove as the piston sleeve reciprocates with respect to the piston mandrel.

18. The straddle packer as claimed in claim 17 comprising four equally spaced-apart auto-J pins.

19. The straddle packer as claimed in claim 17 wherein the hydraulic cylinder is a modular cylinder comprising a plurality of interconnected hydraulic cylinder modules.

20. The straddle packer as claimed in claim 17 the straddle packer further comprises a sliding sleeve connected to the piston sleeve, the sliding sleeve being adapted to compress an uphole packer element of the straddle packer when the auto-J pins are in the auto-J groove pressure-set slots and the auto-J groove stay-set slots.

* * * * *